US005082520A

United States Patent [19]

West et al.

[11] Patent Number: 5,082,520

[45] Date of Patent: Jan. 21, 1992

[54] AUTOMATIC HIGH-SPEED LABELING MACHINE EMPLOYING VARIOUS LINEAR AND ROTATIONAL SPEEDS OF THE CONTAINER

[76] Inventors: Michael J. West; Jimmy D. Williamson, both of 1465 Ellerd Dr., Turlock, Calif. 95380

[21] Appl. No.: 620,896

[22] Filed: Dec. 3, 1990

[51] Int. Cl.[5] ..... B65C 9/04

[52] U.S. Cl. ..... 156/450; 156/458; 156/568; 156/DIG. 13; 156/DIG. 26

[58] Field of Search ..... 156/448, 449, 450, 458, 156/542, 567, 568, DIG. 13, DIG. 26, 556, 571

[56] References Cited

U.S. PATENT DOCUMENTS

| | | | |
|---|---|---|---|
| 2,936,921 | 5/1960 | Schulz | 156/568 |
| 3,783,077 | 1/1974 | Messmer | 156/449 X |
| 3,928,115 | 12/1975 | Kerwin | 156/542 X |
| 4,108,710 | 8/1978 | Hoffmann | 156/450 |
| 4,239,570 | 12/1980 | Kerwin | 156/542 X |
| 4,500,386 | 2/1985 | Hoffmann | 156/449 |
| 4,714,515 | 12/1987 | Hoffmann | 156/450 |
| 4,931,122 | 6/1990 | Mitchell | 156/215 |

FOREIGN PATENT DOCUMENTS 982838 2/1965 United Kingdom ..... 156/571

*Primary Examiner*—Michael W. Ball
*Assistant Examiner*—Mark A. Osele
*Attorney, Agent, or Firm*—Basil Travis

[57] ABSTRACT

Either filled or empty cylindrical containers enter this labeling machine upright on a conveyor which slides beneath them as they are restrained and accumulate in a straight line against a gate for individual admission to a synchronization wheel and timed release between a series of moving parallel belts and stationary pads which laterally engage the container and propel it at various linear and rotational speeds during certain stages of the labeling operation so that the container achieves its greatest linear speeds before and after labeling, its slowest linear but greatest rotational speed during labeling, and moderate linear speeds to enter and exit the machine, thereby resulting in virtual label transfer within one container revolution while maintaining a constant and continuous high speed labeling operation therein.

4 Claims, 1 Drawing Sheet

AUTOMATIC HIGH-SPEED LABELING MACHINE EMPLOYING VARIOUS LINEAR AND ROTATIONAL SPEEDS OF THE CONTAINER

BACKGROUND OF THE INVENTION

1. Field of the Invention

This invention pertains to automatic high-speed labeling machines. More particularly, the present invention relates to automatic high-speed labeling machines for labeling cylindrical containers which are linerally fed through the machine in a straight line, but are caused to rotate about their vertical axes through a point of contact with a rotating cylindrical label transporting drum which results in the transfer of a label to a container and thereby causing the container to wrap said label around itself.

2. Description of the Prior Art

The prior art is replete with descriptions of labeling machines for cylindrical containers which all accomplish the same purpose but by different means.

For example, in U.S. Pat. No. 4,108,710 (1978), Hoffman describes a high-speed labeling apparatus for cans which are fed into and clamped onto the periphery of a rotating drum which moves individual cans past a first adhesive station where an adhesive is applied to each can at a predetermined location thereon and the cans are then moved on to a labeling station. Labels, previously cut from a continuous strip, are held by a pourous rotating vacuum disc or drum whereon the trailing edge of said label receives adhesive and then it is moved into position where the leading edge of said label engages a can at the location of adhesive on the can. As both can and label are moving in the same direction and at the same speed, the vacuum hold on the label is released thereby allowing the label to move away with the can to a wrapping station where the can is released and rolled along a track by a gripping conveyor belt thereby wrapping the label and its trailing edge around the can. This so-called "flagging" method of labeling was the state of the art for many years and was commonly used in the labeling of soup cans, however the flagging method, as described, is essentially limited to containers which can be gripped by the rotating drum in a manner that adhesive may be applied to the container while it travels through the machine for wrapping by a sturdy label such as paper.

In U.S. Pat. No. 4,500,386 (1985), Hoffman discloses a "roll-on" pad opposite and concentric to a rotating vacuum drum between which cylindrical containers are fed by a rotating star wheel. As the container comes into tangential contact with the rotating vacuum drum, a glue-containing label held on the drum is transferred to the container and the container is rotated about its vertical axis by the drum causing the label to be pressed onto said container by the roll-on pad. However, the path of the containers while under control of the star wheel is an S-shaped path which requires change of direction including an inflection at the point of transfer at the point of transfer from the star wheel to the vacuum drum and roll-on pad, and these changes of direction impose acceleration and loads which limit the speed of labeling.

In U.S. Pat. No. 4,714,515 (1987), Hoffman describes a "straight line" container labeling apparatus including oppositely moving main drive and porous labeling belts, and a timing star and second star wheel having rollers on the ends of its arms for engaging and aligning each container while allowing it to rotate freely between the belts. In this apparatus, the leading edge of a continuous strip of label stock is gripped by a radially retracted vacuum pad located on the periphery of a rotating vacuum drum and pulled until a cutting knife carried directly on the drum severs the trailing edge of each label. The retracted vacuum pads are selectively extendable for application of adhesive and then may be retracted to allow fingers to strip each gummed label from the drum and transfer it to a vacuum wheel over which is entrained a porous labeling belt that carries each label to a container driven by the drive belt and aligned by the second star. Although workable in theory, this fairly complex labeling apparatus obviously required critical synchronization of its interrelated elements to function properly. During high speed labeling operations (more than 125 containers per minute) several problems arose. For example, containers would often jam as they left the timing star and became wedged by an arm of the aligning star. Additionally, the reciprocating vacuum pads on the vacuum drum did not provide a uniform glue pattern on the labels which often caused glue to be deposited on the porous labeling belt resulting in labels stuck thereon. Moreover, part of the cutting means was located on the periphery of the vacuum drum which, of course, increased in rotational speed with the speed of the labeling operation, and often resulted in improperly cut labels. Thus, the labeling apparatus as above described was short lived in actual high speed production and is not known to be in use today.

In U.S. Pat. No. 4,931,122 (1990), Mitchell discloses another straight through labeling machine with a "feed-screw" for moving cylindrical containers past, but in tangent to, a vacuum drum containing precut gummed labels. The containers travel along a guide-way to the feed screw where they also contact an endless belt causing the containers to spin counter-clockwise around their vertical axes. As the feed screw advances the containers linearly past, but in tangent to, the vacuum drum, a label is transferred to a container and is preferably wrapped around it before said container exits the feed screw. Although this labeling machine appears to be an improvement over the cited prior art, the counter-clockwise rotation of the containers while being linearly advanced within the feed screw causes vertical drag or a retarding force acting on the containers due to friction which is undesirable in high speed labeling operations.

3. OBJECTS OF THE PRESENT INVENTION

Accordingly, it is the general object of the present invention to provide a high-speed labeling machine with a minimum of vertical drag or rotational friction at the point of label transfer to the container.

It is another object of the present invention to provide a high-speed labeling machine wherein the linear and rotational speeds of the containers vary at various stages of the labeling operation to provide decreased linear speed but increased rotational speed of the containers at the point of label transfer.

It is yet another object of the present invention to provide a high-speed labeling machine which is capable of transferring a label to a container within a linear distance traveled by the container as it makes one revolution of the container or in a linear distance of approximately 10% of the label's length.

It is yet a further object of the present invention to provide a high-speed labeling machine which brings about transfer of a precut label to a container by tangential contact between a hotmelt adhesive on the reverse side of a label and the side of a container.

It is still a further object of the present invention to provide a high-speed labeling machine which causes a labeled container to rapidly exit the point of label transfer by increasing its linear speed but with stability.

It is still yet a further object of the present invention to provide a high-speed labeling machine which includes a means for firmly pressing the label to a container before the container exits the machine.

It is even a furthermore object of the present invention to provide a high-speed labeling machine for previously filled cylindrical plastic containers of carbonated beverages so that they are not excessively agitated during labeling.

These objects are achieved in the present invention.

SUMMARY OF THE INVENTION

The present invention provides an automatic high-speed labeling machine in which individual labels are produced from a continuous strip of paper or the like from a roll fed by a label drive wheel, over a brake control arm, and web guide rollers through a vacuum assisted rotating cutter head to a label transport wheel where the rear sides of individual labels receive a coating of hotmelt glue and are then transferred to the sides of cylindrical containers.

The containers enter the machine upright on a moving infeed conveyor chain with their vertical axes perpendicular to said chain and in a single straight line until their movement is regulated by a product control gate. The product control gate admits an individual container to a container synchronization wheel which properly times and places each container between a moving lateral container drive belt and a lateral stationary infeed container drive pad which are parallel and tangentially engage the cylindrical sides of the container causing it to move forward at a greater linear speed than that of the moving infeed conveyor chain, but also causing the container to undergo counter-clockwise rotation around its vertical axis.

The container, being laterally propelled by the container drive belt, leaves the stationary infeed container drive pad and then next laterally and oppositely engages a pair of upper and lower bottle spinning belts, parallel to the container drive belt, but traveling at a slower linear speed in a clockwise direction. The cylindrical container, now under the control of oppositely traveling but parallel lateral belts at different linear speeds, is forced to increase its counter-clockwise rotational speed but also decrease its linear speed for a brief point of tangential contact with the glue coating on the rear side of a precut label which is held on the periphery of the label transport wheel. It is this brief pause or interruption of linear speed at the point tangential to the rotating label transport wheel which is believed responsible for and enables the container to pull the label from the label transport wheel by the glue coating thereby causing the container to wrap the label around itself in essentially one revolution, and this feature of the present invention is believed an important improvement over the prior art because the application of a label in this manner virtually eliminates vertical drag and rotational friction at the point of label transfer. In other words, since the linear speed of the container is slowed but rotating at the same peripheral speed, but oppositely, at the point of tangential contact with the label transport wheel, the label is virtually transferred before the container leaves the wheel.

Once the labeled container, under control of the container drive belt, leaves the label transport wheel, the container's linear speed increases while its rotational speed decreases as the container is rolled laterally around its vertical axis along a discharge container compression pad which is parallel with said drive belt to insure that the label is pressed firmly to the container. As the container leaves the compression pad and drive belt, it is once again controlled and propelled at a slower linear speed by the discharge conveyor chain to exit the machine.

To briefly sum-up, and what is believed to be a novel improvement over the prior art is that a container traveling through the machine of the present invention undergoes several different linear and rotational speeds at various stages to achieve desired results. For example, it enters and exits the machine at medium speed; it achieves its greatest linear speed just before and after labeling; and it travels slowest linearly while in contact with the label transport wheel. Because the linear speed is inversely proportional to the rotational speed of the container while traveling through the machine, the speeds are regulated to allow the same number of containers to enter as exit the machine while providing a constant, continuous high-speed labeling operation therein.

DESCRIPTION OF THE PREFERRED EMBODIMENT

Figure 1:
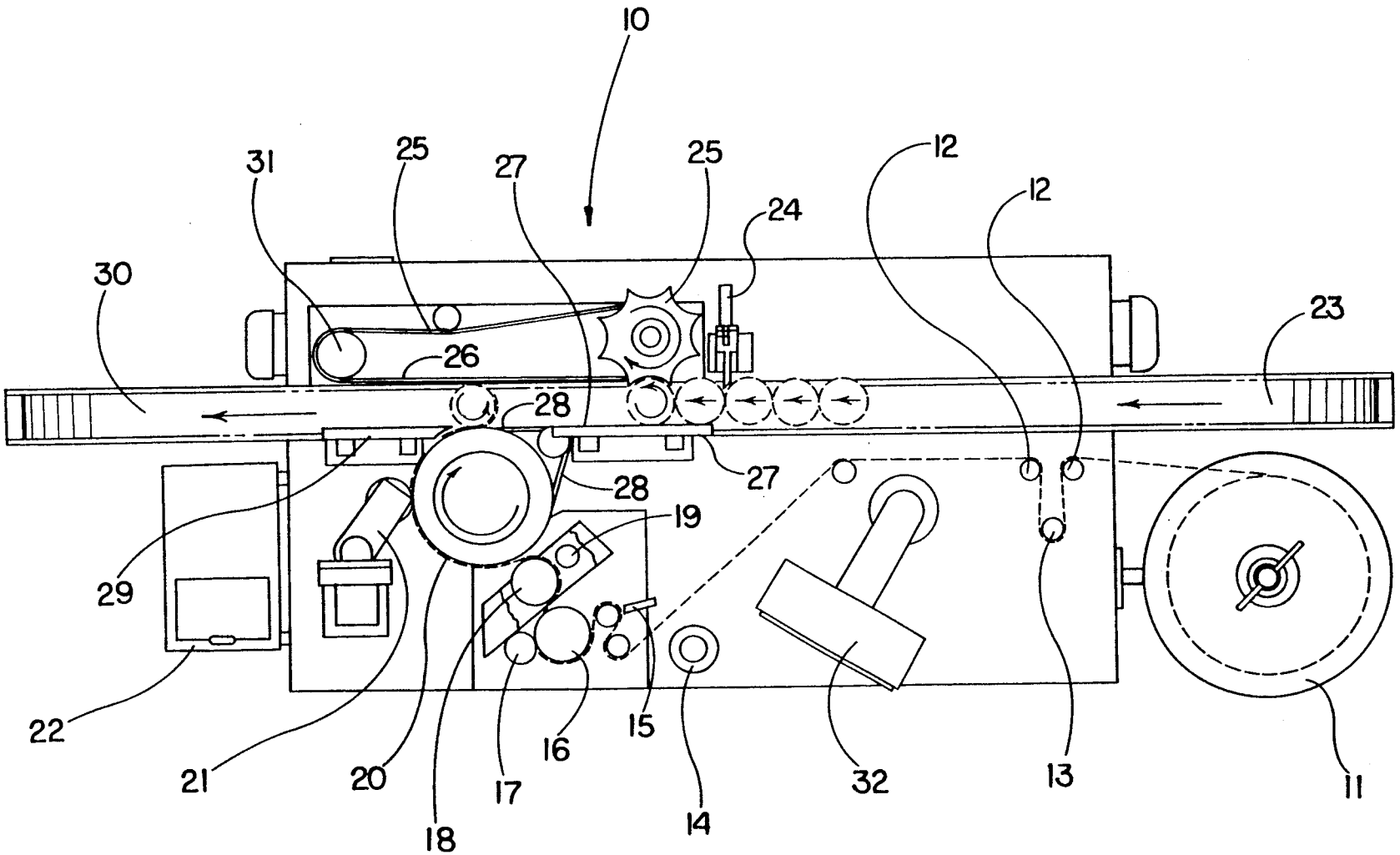
FIG. 1 is a top plan view of the present invention.

Turning now to the drawing, the reference numeral 10 generally refers to the Automatic High-Speed Labeling Machine of the present invention and, more particularly the FIG. 1 is an illustration of a top plan view thereof looking directly down on its essential elements. It should be said at the outset that this machine 10 is powered by electrical current, electric motors and other components that are all well known in the art so that no claim shall be herein made to any individual element but as to only their particular combination in this embodiment which is believed to achieve a unique, novel and nonobvious means of performing the task of labeling cylindrical containers.

The machine 10 provides a label roll unwind support disk 11 from which a continuous strip of paper labels or the like is dispensed through the machine 10 as illustrated by the broken lines. The continuous strip of paper labels, preferrably provided by the unwinding of a roll on said disk 11, is first fed between a pair of label web guide rollers 12 and a label unwind brake control arm 13 to provide tension in and to keep the continuous strip taut as it moves past a label cut position adjusting switch 14 and label registration cut-off sensor 15 to the label drive wheel 16. The label drive wheel 16 in tangential cooperation with a label drive tension wheel 17 not only pulls the continuous strip from the support disk 11 but also feeds said strip onto a vacuum assisted rotating cutter head 18 where the strip is cut into individual labels by a cutting system engagement blade 19. The individual label, now cut into its proper size, is then rolled onto the periphery of a label transport wheel 20 which has a porous surface and a slight internal vacuum thereby causing said label to releasably adhere to the periphery of said wheel 20 as it turns in a clockwise direction. The precut label now rotated with its rear side facing outwardly to the periphery of the rotating label transport wheel 20 contacts a hotmelt glue applicator wheel 21 to apply glue from a hotmelt glue pumping system 22 and then the label is further rotated to contact a container.

Cylindrical containers, filled or empty and illustrated in FIG. 1 as broken circles, enter the automatic high-speed labeling machine 10 from any number of usual means, such as by an auxiliary conveyor, where they are deposited in an upright position and in an essentially straight line onto a moving conveyor chain 23, said chain constantly moving linearly, as indicated by the left arrows, through the machine 10 to provide an accumulation of containers being releasably restrained by a product control gate 24. The moving conveyor chain 23 slides beneath the bottoms of accumulated containers causing the containers to be forced against the gate 24 until it momentarily opens to allow the passage of a single container to a container synchronization wheel 25, thereby advancing the line of accumulated containers.

The container synchronization wheel 25, turning in a clockwise direction laterally engages the sides of a container for timing its release so that the container will meet the edge of a precut glued label on the label transport wheel 20, however the container is also caused to slowly spin counterclockwise around its vertical axis as it leaves said wheel 25 by being laterally rolled between a container drive belt 26, moving linearly (to the left in FIG. 1), and a stationary infeed container drive pad 27 for the purpose of giving the container a rapid linear motion but a slower rotational motion, which causes the container to rapidly move away from the wheel 25 and allows yet another to enter through the product control gate 24.

As a container approaches the label transport wheel 20, it is discharged from the stationary infeed container drive pad 27 and engages a pair of upper and lower bottle spinning belts 28 which are circumferentially connected around the periphery of the label transport wheel 20 but also are traveling linearly to the right (clockwise) at the same peripheral speed as the circumference of the label transport wheel 20 but parallel with the oppositely moving container drive belt 26. Because the container drive belt 26 is moving to the left slightly faster than the bottle spinning belts 28 are moving to the right, the container trapped between these said parallel belts is forced to increase its rotational speed to virtually equal that of the label transport wheel 20 while the container's linear speed is decreased. It is this brief change in linear and rotational container speeds at the point of tangential contact with the label transport wheel 20 which slows the container's linear speed sufficiently to allow it enough time to contact the leading edge of a precut glued label, smoothly lift it from the wheel 20, and allow the container to wrap the label around the container in essentially one revolution or within 10% of the label's length. This feature of variable container speeds through the stages of labeling is believed to be an advantage of the present invention over the prior art as vertical drag and rotational friction on the label is virtually eliminated at the point of label transfer since the container merely wraps the label around itself as it is rolled between the container drive belt 26 and the label transport wheel 20, thereby resulting in precise and efficient high-speed labeling.

As a labeled container leaves the label transport wheel 20, it is rolled around its vertical axis counterclockwise along a stationary discharge container compression pad 29 by the parallel container drive belt 26 moving linearly to the left thereby causing the container's linear speed to increase while decreasing its rotational speed but also insuring that the label is pressed firmly to the container.

When the labeled container leaves said compression pad 29, it is positioned on a moving discharge conveyor chain 30 to exit the machine 10.

The relationship between linear and rotational machine and container speeds as utilized in the present invention is well known in mathematics where the average linear speed (v) of an object which travels a linear distance (s) in time (t) is defined by $$s = vt$$

and the rotational speed (w) of an object is known as its time rate of angular displacement ($\phi$) about an axis in radians. Since a radian is defined as the length of arc divided by the length of radius, the relationship of rotational speed to angular displacement is often expressed by $$\phi = wt$$

and therefore the correlation between linear and rotational speeds of a cylindrical container moving through the labeling machine 10 may be given by $$v = wr$$

where (r) is the radius of the container. Stated another way, linear speed is inversely proportional to the container's rotational speed but it is also dependent upon its radius.

It is obvious from the above mathematical relationships that not all cylindrical containers will travel through the machine 10 at the same linear and rotational speeds unless they have the same diameter. Thus, the machine 10 must be adjusted to accomodate a particular series of containers of the same diameter to ensure that, firstly, the parallel distances between the pads, wheels and belts (reference numerals 25 through 29) are all sufficient to securely engage and propel the container, and, secondly, that the wheels (20 and 25) rotate in proper relationship to the speeds of the belts (26 and 28).

The first parallel adjustment adjustments are easily made by mechanically moving the infeed container drive pad 27 and the discharge container compression pad 29 either inwardly or outwardly of the parallel container drive belt 26. This adjustment establishes the proper distance of the container diameter between the container synchronization wheel 25 and the infeed container drive pad 27. For containers with very large or small diameters, it is also possible to mechanically move the container synchronization wheel 25 with its container drive belt wheel 31 inwardly or outwardly of said pads (27 and 29) but this is not usually necessary since the belts 26 and 28 are flexible enough to accomodate slight variences in diameter and this feature is felt to be yet another advantage over the prior art because the belts also absorb vibration of the moving containers which is very important for containers such as plastic bottles previously filled with carbonated beverages that expand during labeling due to vibration.

Machine 10 speeds are basically controlled by a swivelling operator control panel 32 which essentially controls all functions of the machine 10 produced by a motor and central drive shaft which are located beneath the workpiece illustrated in FIG. 1, but are not illustrated since they are common components of labeling machines known in the prior art. The central drive shaft in turn regulates all linear and rotational functions of the machine 10 by a series of gears and chains which in turn drive the belts and wheels. To enable anyone skilled in the art to make and operate the machine 10, as required for full disclosure, a specific example is given.

For example, if container with known diameter (d) need be labeled, it is important to adjust the speed of the container drive belt 26 so that it travels slightly faster to the left than the bottle spinning belts 28 traveling to the right, so that the containers will continue to travel to the left, but yet not so fast at the point of label transfer. Since all linear and rotational functions emerge from gears and chains originating from a central vertical drive shaft, one skilled in the art need only know the rotational speed (w-1) of the label transport wheel 25 and the length of label to calculate the linear speed (v-2) needed for the container drive belt 26 to sufficiently slow the container and allow it to complete nearly one revolution or length of arc equal to the label length (whichever is less) while in tangent to the label transport wheel 25.

If the diameter of the container is 3" and a label is to be completely wrapped around it making the label length or length of arc (3"×3.14) or about 9½", the angular displacement of the container while tangent to the wheel 25 will require a certain amount of time (t) which is calculated from (w-1) using the second equation. Once the time is known, the minimum linear speed (v-2) of the belt 26 traveling to the left which is necessary to accomplish labeling while continuing to move the container to the left is determined by the first equation and once this speed is known, the size (radius) of the container drive belt wheel 31 needed for the proper belt 26 speed may be also calculated from the second equation.

The increased efficiency of high-speed labeling produced by this machine 10 is primarily due to the containers being quickly moved into and away from the labeling wheel 25 at high linear speed, but are momentarily slowed just enough while tangent to the wheel 25 to remove the label. By increasing the container's rotation while it is tangent to the wheel 25, its time there is minimal, thereby providing a constant, continuous and automatic high-speed labeling operation thereby.

Having described our invention with particularity, we claim:

1. An automatic high-speed labeling machine for labeling cylindrical containers, said machine comprising in combination:

A. means for dispensing individual labels from a continuous strip of labeling material, said dispensing means comprising:
   i. a label unwind support disk for unwinding a roll of labeling material;
   ii. a pair of label web guide rollers in combination with a label unwind brake control arm to keep the continuous strip of labeling material taut as it moves between them;
   iii. a label drive wheel in tangential cooperation with a label drive tension wheel for pulling the continuous strip of labeling material from the label unwind support disk;
   iv. a vacuum assisted rotating cutter head in cooperation with a cutting system engagement blade for cutting an individual label from its continuous strip of labeling material;
   v. a label transport wheel having a porous surface and internal vacuum causing the individual label to releasably adhere thereto as said label is received from the cutting system;
   vi. a hotmelt glue applicator wheel in conjunction with a hotmelt glue pumping system for application of glue to the rear side of an individual label as it is turned on the label transport wheel to tangentially meet the side of an incoming container;

B. means for receiving, propelling and discharging either filled or unfilled cylindrical containers traveling upright and in a straight line through the machine but at different linear and rotational speeds during various stages of the labeling operation, said means comprising:
   i. a linearly moving conveyor chain for receiving containers upright but also sliding beneath said containers as they are accumulated and forced against a product control gate in a straight line;
   ii. a product control gate to regulate passage of individual containers to a container synchronization wheel;
   iii. a container synchronization wheel turning clockwise to receive a container from the product control gate for properly timed release to a container drive belt;
   iv. a container drive belt turning also clockwise but in a partial parallel cooperation with a stationary infeed container drive pad for laterally receiving a container from the container synchronization wheel, but causing said container to begin slowly rotating counter-clockwise as it is rapidly propelled linearly at the same speed as the container drive belt;
   v. a set of parallel upper and lower bottle spinning belts traveling clockwise but in slightly slower partial parallel cooperation with the container drive belt, all said belts laterally receiving a container from the stationary infeed container drive pad thereby causing it to rapidly rotate around its vertical axis but also slowing the container's linear speed as it approaches the label transport wheel;
   vi. said label transport wheel with porous surface and internal vacuum for releasably holding a label as said wheel while turned at the same peripheral speed as the linear speed of the bottle spinning belts causes tangential contact between the glue coating of the label thereon and rotating container thereby enabling the container to remove the label from said wheel and wrap the label around itself in a linear distance traveled by the container as it makes essentially one revolution or in a linear distance traveled by the container equal to 10% of the label's length, whichever is less;
   vii. a stationary discharge container compression pad parallel to and in cooperation with the moving container drive belt for receiving a labeled container from the label transport wheel and for causing said container to be rolled around its vertical axis thereby pressing the label firmly thereon, but also rapidly increasing the container's linear speed to quickly exit away from the label transport wheel by decreasing the rotational speed of said container;

viii. a linearly moving discharge conveyor chain for receiving labeled containers from the stationary discharge container compression pad and container drive belt causing the containers to exit the machine.

2. An improved automatic high-speed labeling machine of the type in which opposite sides of upright cylindrical containers are engaged by parallel belts, one of which moves in a slower linear direction than the other for rotating and linearly propelling containers tangentially past a rotating label transport means for transferring a label to a container, the improvement comprising:

A. a pair of stationary pads, one positioned linearly ahead of and the other positioned linearly behind the slower moving parallel belt, for laterally engaging one side of a container thereby causing its linear speed to increase but its rotational speed to decrease as the container is rolled along said pads for rapid entrance and exit from a label transport means; and wherein B. said rotating label transport means rotates at the same peripheral speed and in cooperation with the linear speed of the slower moving parallel belt for receiving a container and said container trapped between said parallel belts is forced to decrease its linear speed while increasing the container's rotational speed to equal that of the said rotating label transport means so that a container may lift and wrap a label around itself while essentially in tangential contact with said rotating label transport means.

3. The labeling machine of claim 2, including a timing means for releasing individual containers to said parallel belts.

4. The labeling machine of claim 2 wherein the rotating label transport means includes an internal vacuum means for holding labels until they are transferred to containers.

* * * * *